US005515091A

United States Patent [19]

Kimura et al.

[11] Patent Number: 5,515,091

[45] Date of Patent: May 7, 1996

[54] REPLACEABLE INK TANK

[75] Inventors: Makiko Kimura, Sagamihara; Tsutomu Abe, Isehara; Akio Saito, Hadano; Hiroshi Nakagomi, Yamato, all of Japan

[73] Assignee: Canon Kabushiki Kaisha, Tokyo, Japan

[21] Appl. No.: 186,885

[22] Filed: Jan. 26, 1994

Related U.S. Application Data

[63] Continuation of Ser. No. 115,664, Sep. 2, 1993, abandoned, which is a continuation of Ser. No. 906,456, Jun. 30, 1992, abandoned, which is a continuation of Ser. No. 463,482, Jan. 11, 1990, Pat. No. 5,155,502.

[30] Foreign Application Priority Data

Jan. 13, 1989 [JP] Japan ..... 1-7407

[51] Int. Cl.[6] ..... B41V 2/175; B41V 2/05

[52] U.S. Cl. ..... 347/86

[58] Field of Search ..... 347/86, 87, 85

[56] References Cited

U.S. PATENT DOCUMENTS

| | | | |
|---|---|---|---|
| 3,967,286 | 6/1976 | Andersson et al. | 347/87 |
| 4,306,245 | 12/1981 | Kasugayama et al. | 347/87 X |
| 4,313,124 | 1/1982 | Hara . | |
| 4,345,262 | 8/1982 | Shirato et al. . | |
| 4,368,478 | 1/1983 | Koto | 347/86 |
| 4,419,678 | 12/1983 | Kasogayama | 347/86 |
| 4,459,600 | 7/1984 | Sato et al. . | |
| 4,463,359 | 7/1984 | Ayata et al. . | |
| 4,558,333 | 12/1985 | Sugitani et al. . | |
| 4,633,274 | 12/1986 | Matsuda | 347/86 |
| 4,712,172 | 12/1987 | Kiyohara et al. | 347/87 |
| 4,723,129 | 2/1988 | Endo et al. . | |
| 4,740,796 | 4/1988 | Endo et al. . | |
| 4,771,295 | 9/1988 | Baker et al. | 347/87 |
| 4,775,871 | 10/1988 | Abe et al. . | |
| 4,969,759 | 11/1990 | Suzuki et al. | 400/124 |
| 5,095,321 | 3/1992 | Saito et al. . | |
| 5,155,502 | 10/1992 | Kimura et al. | 347/87 |
| 5,156,470 | 10/1992 | Suzuki et al. | 400/124 |
| 5,156,471 | 10/1992 | Suzuki et al. | 400/124 |
| 5,156,472 | 10/1992 | Suzuki et al. | 400/124 |
| 5,156,473 | 10/1992 | Suzuki et al. | 400/124 |
| 5,158,377 | 10/1992 | Suzuki et al. | 400/124 |
| 5,174,665 | 12/1992 | Suzuki et al. | 400/124 |
| 5,182,581 | 1/1993 | Kashimura et al. | 347/87 |
| 5,221,148 | 6/1993 | Suzuki et al. | 400/124 |
| 5,328,279 | 7/1994 | Suzuki et al. | 400/124 |
| 5,421,658 | 6/1995 | Suzuki et al. | 400/124 |

FOREIGN PATENT DOCUMENTS

| | | | |
|---|---|---|---|
| 0139508 | 5/1985 | European Pat. Off. . | |
| 0261764 | 3/1988 | European Pat. Off. | B41J 27/18 |
| 2575413 | 7/1986 | France | B41J 3/04 |
| 59-123670 | 7/1984 | Japan | B41J 3/04 |
| 59-138461 | 8/1984 | Japan | B41J 3/04 |
| 61-012352 | 1/1986 | Japan | B41J 3/04 |
| 61-249757 | 11/1986 | Japan | B41J 3/04 |
| 63-022653 | 1/1988 | Japan | B41J 3/04 |
| 63-009544 | 1/1988 | Japan | B41J 3/04 |
| 2203386 | 10/1988 | United Kingdom | B41J 3/04 |

*Primary Examiner*—Joseph W. Hartary

*Attorney, Agent, or Firm*—Fitzpatrick, Cella, Harper & Scinto

[57] ABSTRACT

A replaceable ink tank, removably connectable to an ink jet head body, comprises a container providing a reservoir for liquid ink to be supplied to a print head on the ink jet head body and having opposing side walls configured for guiding the side walls of the ink jet head body as the container and ink jet head body are being connected. The container includes an ink supply port positioned relative to the side walls for accepting an ink communication pipe of the ink jet head body. An engaging member on each of the container side walls engages a respective coupling member on the ink jet head body for connecting the container with the ink jet head body and holding the ink tank and the ink jet head body together with an absorbing member in the container compressed by the ink communication pipe to enable delivery of ink in said absorbing member to the ink communication pipe. Communication pipe with an ink-introducing port held in pressure abutment with the absorbing member to compress the absorbing member when the ink-jet head body is coupled to the ink storage portion. This assures a good flow of ink to the ink-jet head body.

9 Claims, 4 Drawing Sheets

REPLACEABLE INK TANK

This application is a continuation of application Ser. No. 08/115,664 filed Sep. 2, 1993, now abandoned, which in turn is a continuation of application Ser. No. 07/906,456 filed Jun. 30, 1992, now abandoned, which in turn is a continuation of application Ser. No. 07/463,482 filed Jan. 11, 1990, now U.S. Pat. No. 5,155,502 issued Oct. 13, 1992.

BACKGROUND OF THE INVENTION

1. Field of the Invention

The present invention relates to a liquid discharge or spray recording head and, more particularly, to a liquid spray recording head (to be also referred to as an "ink-jet cartridge" hereinafter) integrally formed with an ink storage portion (to be also referred to as an "ink tank" hereinafter) serving as a supply source of a recording liquid (to be also referred to as an "ink" hereinafter).

2. Related Background Art

A conventional liquid spray recording apparatus (to be also referred to as an "ink-jet printer" hereinafter) comprises a recording head for discharging or injecting an ink onto a recording medium and an ink supply source which is separately arranged at a remote position to supply an ink to the recording head. The recording head and the ink supply source are connected through an ink supply system including a supply pipe and the like.

Since an ink-jet printer of this type generally requires a long supply pipe, cumbersome connections are involved in assembly, and evaporation of the ink and formation of air bubbles in the ink tend to occur.

There has been proposed an ink-jet printer in which a head and an ink supply source are constituted by an integral unit, as disclosed in 63-22653, U.S. Pat. No. 5,095,321 and the like. In such a proposal, ink evaporation and formation of air bubbles in the ink can be eliminated. In addition, piping is not required. Handling of an ink supply system including the head and the ink supply source can be facilitated.

The process for manufacturing the above recording head includes a step of connecting a recording head body to an ink tank. In this case, easy mounting at the time of connection between the head body and the ink tank and a stable ink flow in a mounted state must be assured.

SUMMARY OF THE INVENTION

It is an object of the present invention to provide an ink-jet head body and an ink storage portion that are integrally mountable to form an ink jet cartridge that assures a stable ink flow when the head body and storage portion are in a mounted state.

In accordance with one aspect of the present invention, an ink-jet head body integrally mountable to an ink storage portion to form an ink-jet cartridge, the ink storage portion including an absorbing member for absorbing ink and a supply port for supplying ink to the ink-jet head body, comprises an ejection port and an energy generating element for generating energy used for ejecting ink, the energy generating element being arranged in correspondence with the ejection port, a first coupling member for coupling with a second coupling member of the ink storage portion when the ink-jet head body and the ink storage portion are integrally mounted together, and an ink communication pipe disposed for insertion into the supply port upon coupling of the first and second coupling members during mounting of the ink-jet head body on the ink storage portion so that an ink-introducing port of the ink communication pipe is held in pressure abutment with the absorbing member to compress the absorbing member when the ink-jet head body and the ink storage portion are coupled to each other by the first and second coupling members.

In accordance with another aspect of the invention, an ink storage portion integrally mountable to an ink-jet head body to form an ink-jet cartridge, the ink-jet head body including an ejection port, an energy generating element for generating energy used for ejecting ink, the energy generating element being arranged in correspondence with the ejection port, and a first coupling member, comprises a second coupling member for coupling with the first coupling member of the ink-jet head body when the ink storage portion and the ink-jet head body are integrally mounted together, an absorbing member for absorbing ink, and a supply port for supplying ink to the ink-jet head body, wherein the supply port is disposed for cooperation with an ink communication pipe of the ink-jet head body inserted into the supply port upon coupling of the first and second coupling members during mounting of the ink-jet head body on the ink storage portion so that an ink-introducing port of the ink communication pipe is held in pressure abutment with the absorbing member to compress the absorbing member when the ink-jet head body and the ink storage portion are coupled to each other by the first and second coupling members.

DETAILED DESCRIPTION OF THE PREFERRED EMBODIMENT

The present invention will be described in detail with reference to the accompanying drawings.

Figure 1A:
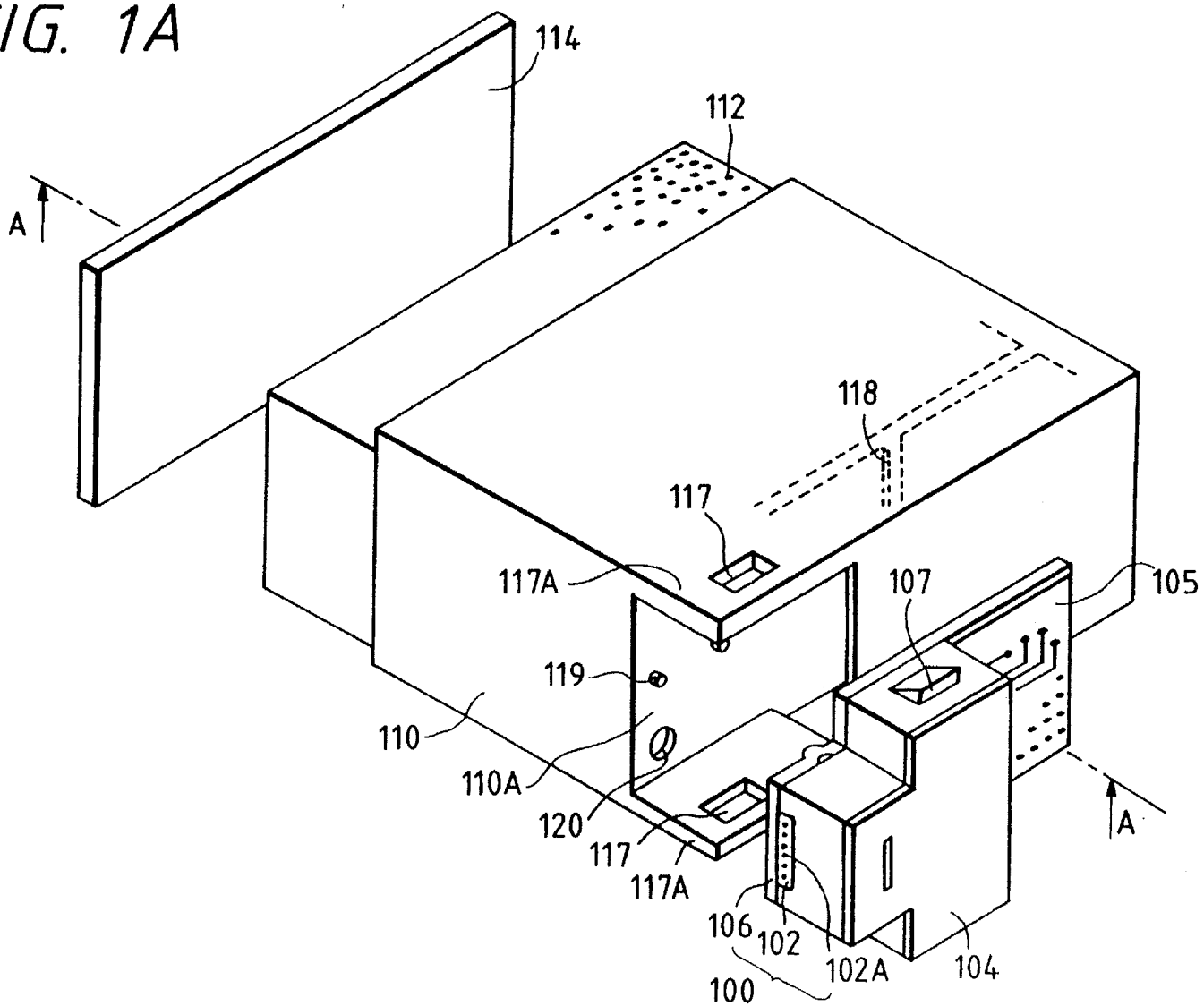
FIGS. 1A and 1B are an exploded perspective view and a perspective view showing an arrangement of an ink-jet recording head according to an embodiment of the present invention.
Figure 1B:
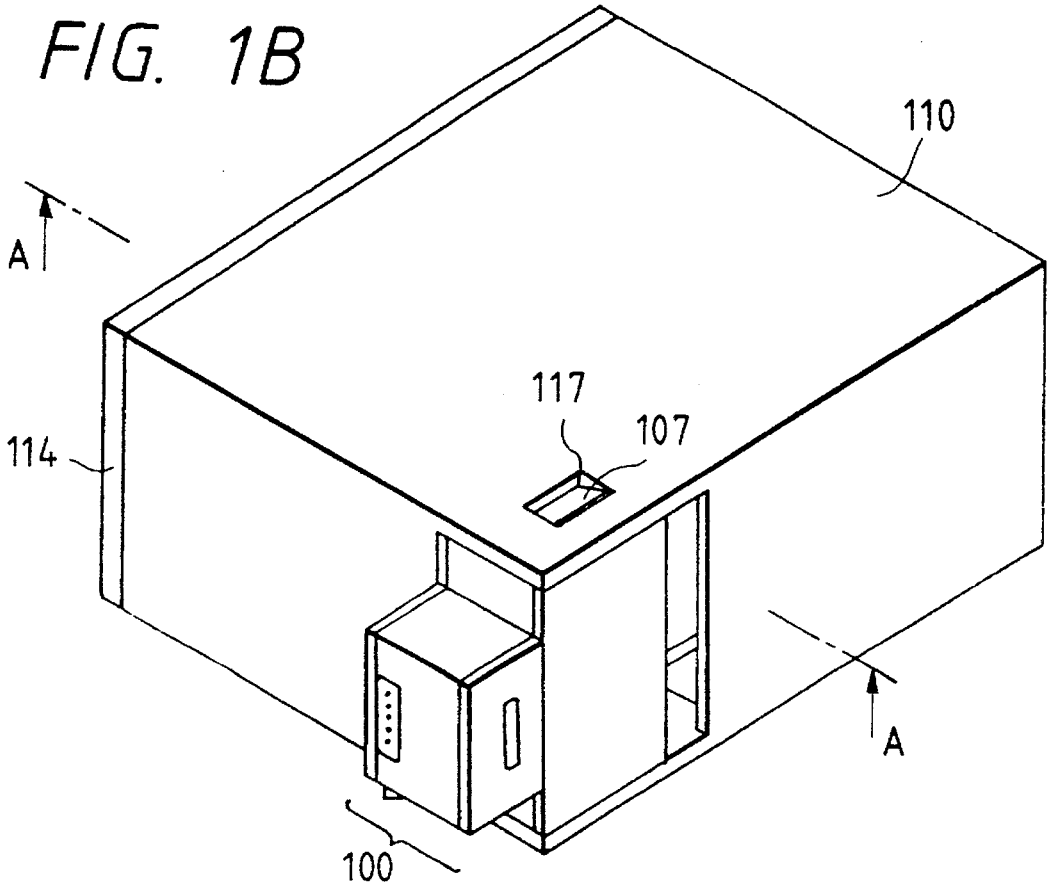

FIGS. 1A and 1B show an ink-jet recording head according to an embodiment of the present invention. More specifically, the ink-jet recording head is a disposable head in which an ink tank serving as an ink storage member is formed integrally with a recording head element.

A recording head element 100 includes an injection portion 102, a supply tank portion 104, a wiring board 105 having a wiring pattern for transmitting a signal for driving energy generating elements for generating energy for injecting an ink, and a base plate 106 for supporting the injection portion 102, the supply tank portion 104, and the wiring board 105. The injection portion 102 includes injection ports 102A formed in a surface opposite to a recording medium, liquid paths formed inside the injection portion 102, injection energy generating elements such as electricity-heat converters, and a common liquid chamber communicating with the respective liquid paths. The liquid paths and the common liquid chamber constitute an ink path. The supply tank portion 104 serves as a subtank for receiving an ink from an ink tank 110 and supplying it to the common liquid chamber in the injection portion 102. The base plate 106 is made of aluminum or the like and also serves as a heat radiation plate for suppressing heat generation of the head element upon driving of the electricity-heat converters.

An ink absorbing member 112 is arranged inside the ink tank 110 and is made of a porous material or fibers. A cover member 114 covers the ink tank 110.

Projections 107 are formed on the head element 100 and have tapered portions which facilitate connection with the ink tank 110. An opening 117 is formed in each wall portion 117A of an element storage portion 110A of the ink tank 110 and engaged with the corresponding projection 107 to couple the head element 100 to the ink tank 110. An abutment member 118 is formed in the element storage portion 110A to facilitate mounting of the head element 100 and assure its mounted state. The abutment member 118 is engaged with the rear end face of the base plate 106. A projection 119 positions the head element 110. A supply port 120 supplies an ink from the ink tank 110 to the head element 100. The detailed structure of these members will be described later.

An ink-jet printer (FIG. 2) using the ink-jet recording head having the above arrangement, i.e., an ink-jet printer using a disposable cartridge recording head, can be obtained.

Figure 2:
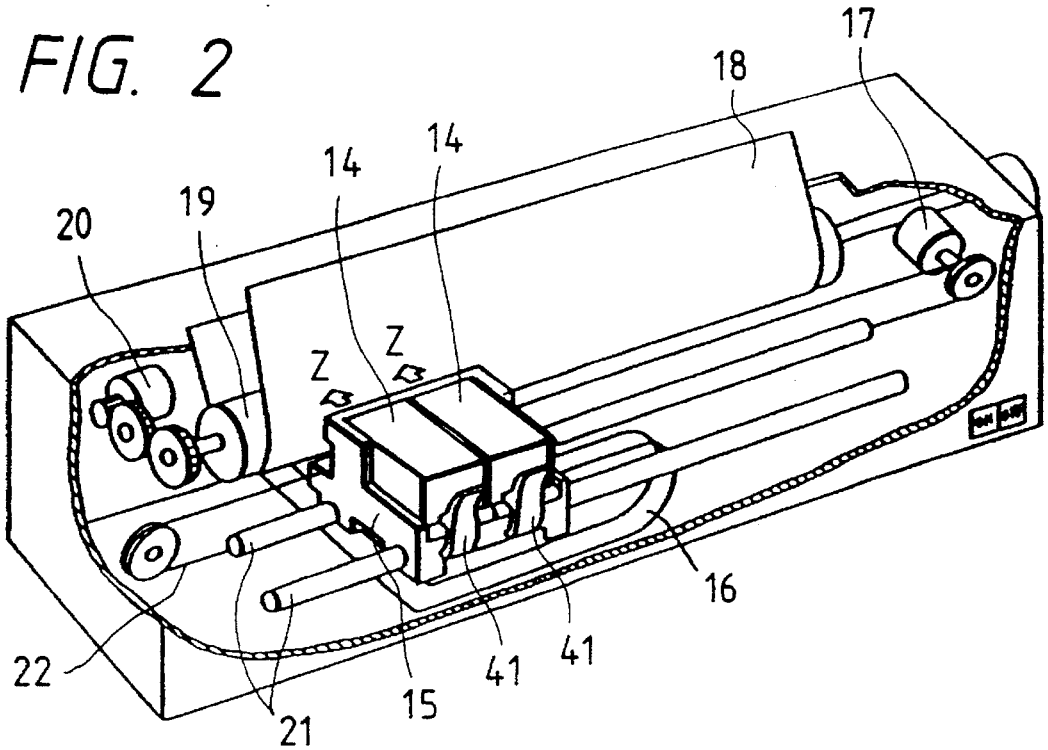
FIG. 2 is a perspective view showing an arrangement of an ink-jet printer using the recording head shown in FIGS. 1A and 1B.

Referring to FIG. 2, the printer includes cartridge recording heads 14 shown in FIGS. 1A and 1B. The recording heads 14 are fixed on a carriage 15 by press members 41 and are reciprocally moved along shafts 21 in the longitudinal direction of the printer. Positioning of the recording heads 14 can be performed by the hole formed on each recording head element 100 and a corresponding dowel formed on the carriage 15.

An ink injected from each recording head reaches a recording medium 18 located on a platen 19 spaced apart from the recording head by a small gap, thereby forming an image on the recording medium 18.

Injection signals corresponding to image data are supplied from an appropriate data supply source to the recording heads through a cable 16 and terminals connected to the cable 16. At least one cartridge 14 (two cartridges in FIG. 2) can be arranged in accordance with the number of colors of inks to be used.

Referring to FIG. 2, the printer also includes a carriage motor 17 for driving the carriage 15 along the shafts 21, and a wire 22 for transmitting a driving force of the motor 17 to the carriage 15. In addition, a feed motor 20 is connected to the platen 19 to feed the recording medium 18.

Figure 3A:
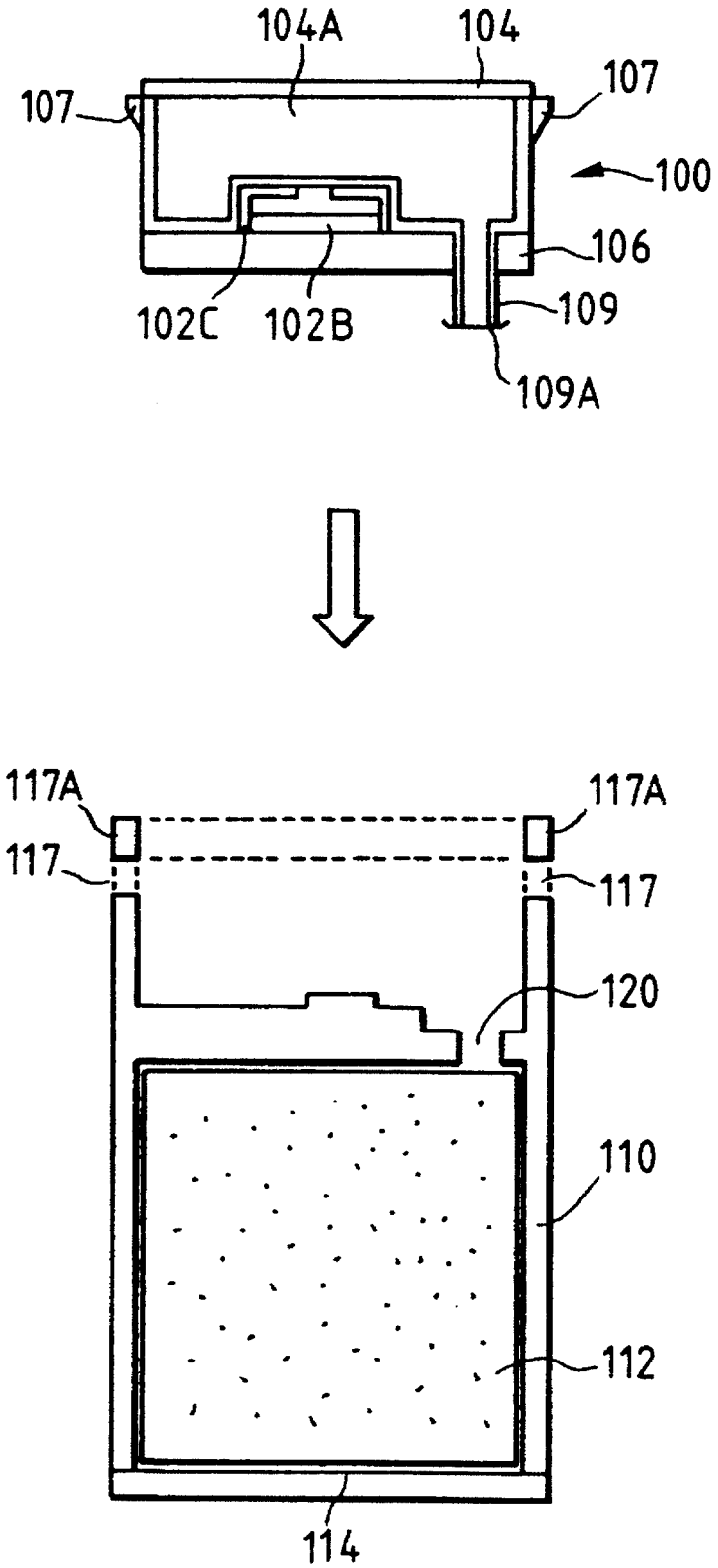
FIGS. 3A and 3B are sectional views showing a method of connecting a recording head element and an ink tank shown in FIGS. 1A and 1B.
Figure 3B:
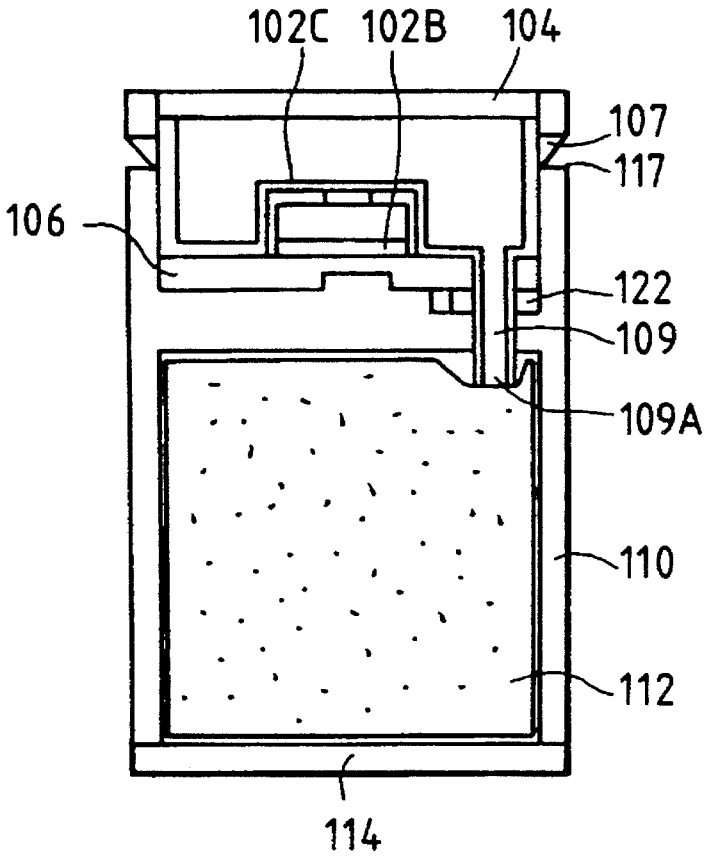

FIGS. 3A and 3B are sectional views taken along the lines A—A of FIGS. 1A and 1B, respectively. A method of mounting the head element 100 on the ink tank 110 will be described with reference to FIGS. 3A and 3B.

Referring to FIGS. 3A and 3B, a communication pipe 109 is connected from the supply tank portion 104 of the head element 100 and extends through the base plate 106. The communication pipe 109 can extend into the ink tank 110 through a supply port 120. A filter 109A is mounted at the distal end of the communication pipe 109 to prevent air bubbles from entering from the ink tank 110 to a supply tank chamber 104A. A heater board 102B has electricity-heat converters (heaters) as injection energy generation elements thereon. A top plate 102C is combined with the heater board 102B to constitute the injection portion 102. Therefore, the injection ports 102A, the liquid paths communicating with them, and the common liquid chamber for receiving ink from the supply tank chamber 104A and supplying it to the respective ink paths are formed.

In order to connect the head element 100 to the ink tank 110, the head element 100 is mounted on the ink tank 110 in a direction indicated by an arrow in FIG. 3A. At this time, upon engagement of the tapered surface of the projection 107 and the opening 117 formed in the wall portion 117A of the ink tank 110, the wall portion 117A is widened outward. At the same time, the communication pipe 109 enters into the supply port 120.

When the projection 107 is located at a position perfectly opposite to the opening 117, the wall portion 117A returns to the initial position by its spring force. The projection 107 is perfectly fitted in the opening 117 to obtain a mounted state shown in FIG. 3B. The guide port at the distal end of the communication pipe 109 is held in pressure abutment with the absorbing member 112, thereby compressing the ink absorbing member and obtaining good ink communication. In FIG. 3B, an O-ring 122 serves as a sealing member for appropriately sealing the ink at the supply port 120.

With the above arrangement, the head element 100 can be connected to the ink tank 110 by simply inserting the head element 100 into the ink tank 110 in the direction indicated by the arrow in FIG. 3A without requiring any operation such as adhering. In addition, the communication pipe 109 connected to the head element 100 is inserted into the ink tank 110, and its distal end abuts against the ink absorbing member 112, thereby assuring the ink communication state.

In the above arrangement, the projections 107 are formed on the head element, and the openings 117 are formed in the wall portions 117A of the ink tank 110. During mounting, the projection 107 is engaged with the opening 117 by utilizing flexibility or elasticity of the wall portion 117A. However, this arrangement may be arbitrarily modified. For example, the wall portion 117A need not have flexibility. Even if the wall portion 117A is rigid, the projection 107 may be supported by a spring or the like and biased outward. In this case, the projection 107 is retracted inward during mounting. When the projection 107 opposes the opening 117, it is fitted in the opening 117 by the biasing force of the spring.

In this embodiment, the head element 100 is formed integrally with a relatively elongated base plate 106. By utilizing this portion, mounting operations including positioning can be further facilitated, and the mounted state can be further guaranteed.

Figure 4:
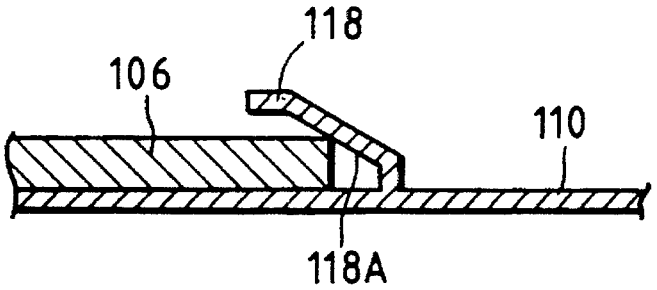
FIG. 4 is a view for explaining a member for assuring a state of connection between the recording head element and the ink tank.

FIG. 4 shows a structure for the above purpose. In this embodiment, a surface of an abutment member 118 formed in the element storage portion 110A of the ink tank 110 is a tapered surface 118A against which the rear end of the base plate 106 abuts. In the abutted state shown in FIG. 4, the projections 107 are positioned with the openings 117, the positioning projection 119 is aligned with a hole (not shown) formed in the base plate 106, and the communication pipe 109 is aligned with the opening 120.

More specifically, when the head element 110 is to be mounted on the ink tank 110, the rear end of the base plate 106 abuts against the tapered surface 118A of the abutment member 118. In this state, the operations shown in FIGS. 3A and 3B are performed to connect the head element 100 to the ink tank 110. In addition to fitting of the projections 107 into the openings 117, the rear end of the base plate 106 is urged against the ink tank 110 by the tapered surface 118A, thereby further assuring a stable mounted state.

As described above, according to this embodiment, the recording head element can be appropriately connected to the ink tank by a simple operation. At the same time, a good ink communication state can be obtained. Therefore, the process for manufacturing the recording head can be simplified, and the manufacturing cost becomes low. When the ink is consumed to a very small amount or runs out, the head element which is more expensive than other members constituting the ink tank need not be replaced. The user may replace only the ink tank, thereby reducing maintenance expenses.

According to the present invention as has been described above, there is provided an ink-jet recording head wherein a recording head body (head element) can be easily connected to the ink tank, and a stable ink communication state in the mounted state can be obtained.

According to the present invention, the energy generating element for generating energy for injecting an ink may comprise a heating element serving as an electricity-heat converter having a heating resistor and electrodes connected to the heating resistor, or a piezoelectric element serving as an electromechanical converter.

In the ink-jet head used in the present invention, the direction for injecting an ink from the injection ports may be the same as or different (e.g., perpendicular to each other) from the direction for supplying an ink to the position in the ink path where the energy generating element is arranged.

The present invention brings about excellent effects particularly in a recording head, recording device of the bubble jet system among the ink jet recording system.

As to its representative constitution and principle, for example, one practiced by use of the basic principle disclosed in, for example, U.S. Pat. Nos. 4,723,129 and 4,740,796 is preferred. This system is applicable to either of the so called on-demand type and the continuous type. Particularly, the case of the on-demand type is effective because, by applying at least one driving signal which gives rapid temperature elevation exceeding nucleate boiling corresponding to the recording information on an electricity-heat convertors arranged corresponding to the sheets or liquid channels holding liquid (ink), heat energy is generated at the electricity-heat convertors to effect film boiling at the heat acting surface of the recording head, and consequently the bubbles within the liquid (ink) can be formed corresponding one by one to the driving signals. By discharging the liquid (ink) through an opening for discharging by growth and shrinkage of the bubble, at least one droplet is formed. By making the driving signals into pulse shapes, growth and shrinkage of the bubble can be effected instantly and adequately to accomplish more preferably discharging of the liquid (ink) particularly excellent in response characteristics. As the driving signals of such pulse shape, those as disclosed in U.S. Pat. Nos. 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

As the constitution of the recording head, in addition to the combination constitutions of discharging orifice, liquid channel, electricity-heat converter (linear liquid channel or right-angle liquid channel) as disclosed in the above-mentioned respective specifications, the constitution by use of U.S. Pat. No. 4,558,333, 4,469,600 disclosing the constitution having the heat acting portion arranged in the flexed region is also included in the present invention. In addition, the present invention can be also effectively made the constitution as disclosed in Japanese Patent Laid-Open Application No. 59-123670 which discloses the constitution using a slit common to a plurality of electricity-heat convertors as the discharging portion of the electricity-heat converter or Japanese Patent Laid-Open Application No. 59-138461 which discloses the constitution having the opening for absorbing pressure wave of heat energy correspondent to the discharging portion.

Further, as the recording head of the full line type having a length corresponding to the maximum width of recording medium which can be recorded by the recording device, either the constitution which satisfies its length by combination of a plurality of recording heads as disclosed in the above-mentioned specifications or the constitution as one recording head integrally formed may be used, and the present invention can exhibit the effects as described above further effectively.

In addition, the present invention is effective for a recording head of the freely exchangeable chip type which enables electrical connection to the main device or supply of ink from the main device by being mounted on the main device, or for the case by use of a recording head of the cartridge type provided integrally on the recording head itself.

Also, addition of a restoration means for the recording head, a preliminary auxiliary means, etc. provided as the constitution of the recording device of the present invention is preferable, because the effect of the present invention can be further stabilized. Specific examples of these may include, for the recording head, capping means, cleaning means, pressurization or aspiration means, electricity-heat convertors or another heating element or preliminary heating means according to a combination of these, and it is also effective for performing stable recording to perform preliminary mode which performs discharging separate from recording.

Further, as the recording mode of the recording device, the present invention is extremely effective for not only the recording mode only of a primary stream color such as black etc., but also a device equipped with at least one of plural different colors or full color by color mixing, whether the recording head may be either integrally constituted or combined in plural number.

We claim:

1. A replaceable ink tank for use with an ink jet head body having plural coupling members and an ink jet print head with an ink communication pipe extending from a surface of the ink jet head body for introducing ink to the print head, said ink tank comprising:

a container providing a reservoir for liquid ink to be supplied to the print head, the container being configured for connecting with the ink jet head body;

an absorbing member in said container to hold said liquid ink therein;

an ink supply port in said container for accepting the ink communication pipe to introduce ink thereto when said container is connected with the ink jet head body; and plural engaging members on said container for engaging respective coupling members on the ink jet head body for connecting said container with the ink jet head body, said engaging members being positioned relative to said ink supply port for holding said ink tank and the ink jet head body together with said absorbing member compressed by the ink communication pipe.

2. A replaceable ink tank as in claim 1, wherein said container has two generally rectangular opposing faces connecting four generally rectangular side walls, said supply port being an opening in one of said faces and said engaging members being disposed on two opposing said side walls.

3. A replaceable ink tank as in claim 1, wherein said engaging members comprise openings for accepting coupling projections on the ink jet head body.

4. A replaceable ink tank removably connectable to an ink jet head body having opposing side walls, each having a coupling member thereon, and an ink jet print head with an ink communication pipe extending from a surface of the ink jet head body at a position relative to the side walls for introducing ink to the print head, said ink tank comprising:

a container providing a reservoir for liquid ink to be supplied to the print head, said container having opposing side walls, each being configured for facing a corresponding side wall of the ink jet head body as said container is being connected with the ink jet head body;

an absorbing member in said container to hold said liquid ink therein;

an ink supply port positioned relative to said side walls of said container for accepting the ink communication pipe when said container is connected with the ink jet head body; and an engaging member on each of said side walls of said container for engaging a respective coupling member on the ink jet head body for connecting said container with the ink jet head body, each said engaging member being positioned relative to said supply port for holding said ink tank and the ink jet head body together with said absorbing member compressed by the ink communication pipe to enable delivery of ink in said absorbing member to the ink communication pipe.

5. A replaceable ink tank as in claim 4, wherein said container has two generally rectangular opposing faces connecting four generally rectangular side walls, said supply port being an opening in one of said faces.

6. A replaceable ink tank as in claim 4, wherein each said engaging member comprises an opening for accepting a coupling projection on the ink jet head body.

7. A replaceable ink tank removably connectable to an ink jet head body having opposing side walls, at least one of the side walls having a coupling member thereon, and an ink jet print head with an ink communication pipe extending from a surface of the ink jet head body at a position relative to the side walls for introducing ink to the print head, said ink tank comprising:

a container providing a reservoir for liquid ink to be supplied to the print head, said container having opposing side walls, each being configured for facing a corresponding side wall of the ink jet head body as said container is being connected with the ink jet head body;

an absorbing member in said container to hold said liquid ink therein;

an ink supply port positioned relative to said side walls of said container for accepting the ink communication pipe when said container is connected with the ink jet head body; and an engaging member on at least one of said side walls of said container for engaging the coupling member on the ink jet head body for connecting said container with the ink jet head body, said engaging member being positioned relative to said supply port for holding said ink tank and the ink jet head body together with said absorbing member compressed by the ink communication pipe to enable delivery of ink in said absorbing member to the ink communication pipe.

8. A replaceable ink tank as in claim 7, wherein said container has two generally rectangular opposing faces connecting four generally rectangular side walls, said supply port being an opening in one of said faces.

9. A replaceable ink tank as in claim 7, wherein said engaging member comprises an opening for accepting a coupling projection on the ink jet head body.

* * * * *

UNITED STATES PATENT AND TRADEMARK OFFICE

CERTIFICATE OF CORRECTION

PATENT NO. : 5,515,091

DATED : May 7, 1996

INVENTORS : MAKIKO KIMURA ET AL.

It is certified that error appears in the above-identified patent and that said Letters Patent is hereby corrected as shown below:

ON THE COVER PAGE

Add --[*] The portion of the term of this patent extending beyond the expiration date of U.S. Patent No. 5,155,502 has been disclaimed.--

After "[45] Date of Patent: May 7, 1996" add --*--.

In "[56] References Cited": Line 6, "Kasogayama" should read --Kasugayama--.

In "[57] Abstract": Line 16, "Communication pipe with an ink introducing port held" should be deleted; lines 17-20 should be deleted.

COLUMN 1

Line 35, "63-22653," should read --Japanese Laid-Open No. 61-249757, Japanese Laid-Open No. 63-22653,--.

COLUMN 3

Line 20, "110." should read --100.--.

COLUMN 4

Line 56, "110" should read --100--.

UNITED STATES PATENT AND TRADEMARK OFFICE

CERTIFICATE OF CORRECTION

PATENT NO. : 5,515,091

DATED : May 7, 1996

INVENTORS : MAKIKO KIMURA ET AL.

It is certified that error appears in the above-identified patent and that said Letters Patent is hereby corrected as shown below:

COLUMN 5

Line 37, "an" should be deleted.
Line 62, "4,558,333,4,469,600" should read --4,558,333 or 4,469,600--.

COLUMN 7

Line 1, "claim 1," should read --claim 2,--.
Line 34, "claim 4," should read --claim 5,--.

Signed and Sealed this

Twelfth Day of May, 1998

Bruce Lehman

*Attest:*

BRUCE LEHMAN

*Attesting Officer*

*Commissioner of Patents and Trademarks*